US005848612A

United States Patent [19]

Currey

[11] Patent Number: 5,848,612

[45] Date of Patent: Dec. 15, 1998

[54] SERVOVALVE EMPLOYING A ROTATABLE FEEDBACK LINKAGE

[75] Inventor: Stephen B. Currey, Tucson, Ariz.

[73] Assignee: Sargent Controls & Aerospace/Dover Diversified Inc., Tucson, Ariz.

[21] Appl. No.: 978,500

[22] Filed: Nov. 25, 1997

[51] Int. Cl.[6] ..... F15B 13/43

[52] U.S. Cl. ..... 137/625.63; 91/374; 91/382; 137/625.64

[58] Field of Search ..... 91/374, 382; 137/625.63, 137/625.64

[56] References Cited

U.S. PATENT DOCUMENTS

| | | | |
|---|---|---|---|
| 2,463,931 | 3/1949 | Wyckoff | 91/374 X |
| 2,969,808 | 1/1961 | Horlacher . | |
| 3,000,363 | 9/1961 | Hayner et al. . | |
| 3,046,945 | 7/1962 | Hayner . | |
| 3,653,409 | 4/1972 | Brannon | 91/374 X |
| 3,875,849 | 4/1975 | Patel | 91/374 X |
| 4,011,891 | 3/1977 | Knutson et al. | 91/382 X |
| 5,573,036 | 11/1996 | Porter et al. . | |

*Primary Examiner*—Gerald A. Michalsky
*Attorney, Agent, or Firm*—Franklin L. Gubernick

[57] ABSTRACT

The invention is a mechanical-type position-sensing and feedback system employed between a main stage spool valve and a pilot stage spool valve of an electro-hydraulic servovalve. The feedback mechanism makes use of a rotatable feedback link that directly senses the position of the slide of the main stage valve and transforms a linear motion of the slide into a linear movement of the sleeve of the pilot stage valve. The feedback link has an elongated body and is adapted for rotation about its body's longitudinal axis.

19 Claims, 2 Drawing Sheets

SERVOVALVE EMPLOYING A ROTATABLE FEEDBACK LINKAGE

FIELD OF THE INVENTION

The invention is in the field of feedback mechanisms for direct drive servovalves. More particularly, the invention is a unique position-sensing and feedback mechanism employed between the main and pilot stages of a multi-stage electro-hydraulic direct drive servovalve. The mechanism makes use of a rotatable linkage engaged at one end to a translatable sleeve of a pilot stage valve and at a second end to a translatable slide of a main stage valve.

BACKGROUND OF THE INVENTION

Electro-hydraulic servovalves are typically used to control fluid flow to a load, such as a hydraulic cylinder. A typical servovalve usually features at least two stages whereby movement of the slide (also known as a spool) of a large, main stage valve is controlled through the movement of a much less massive pilot stage valve. In direct drive servovalves, an electrical actuator is normally connected to the pilot stage valve to control the servovalve's operation.

A common type of direct drive pilot stage valve used with heavy-duty and/or high-flow-rate electro-hydraulic servovalves is very similar in general configuration to the servovalve's main stage valve and is made up of a slide that is movable within a cylindrical sleeve. The sleeve may be in the form of a shaped bore in the valve block or a separate sleeve located within a complementary bore in the block.

When movement of the main stage valve's slide is required, the actuator causes a translation of the pilot stage valve's slide. As the pilot stage valve's slide moves within its sleeve, it uncovers selected ports in the sleeve. This enables pressurized fluid to flow to the main stage valve and create a pressure imbalance in chambers located adjacent opposite ends of the main stage valve's slide. This pressure imbalance causes the main stage valve's slide to shift within its cylinder to thereby enable the flow of pressurized fluid to or from the load in the desired manner.

Once the slide of the servovalve's main stage valve has been shifted through the action of the pilot stage valve, it is a common practice to employ some type of feedback mechanism to cause at least the pilot stage valve, and often the entire servovalve, to return to a neutral or null position. To achieve this result, prior art feedback mechanisms typically include either mechanical or electronic apparatus for sensing the position of either the main stage valve's slide or of an element of the load. In conjunction with the position-sensing apparatus, prior art feedback mechanisms also employ either a mechanical or fluid connection to cause a re-positioning of the pilot stage valve and thereby a re-balancing of the servovalve.

In one prior art servovalve taught by Hayner et al (U.S. Pat. No. 3,000,363), a pivoting linkage is employed to cause translation of the pilot stage valve's sleeve in response to movement of the main stage valve's slide. The linkage pushes on an end face of the pilot stage valve's sleeve and moves the sleeve in a direction opposite to the direction of movement of the main stage valve's slide. This results in a blocking of certain of the sleeve's ports. A hydraulic pressure spring is used in conjunction with the linkage to enable proper operation of the mechanism.

In a prior art servovalve taught by Horlacher (U.S. Pat. No. 2,969,808), a pivot member applies pressure to one end of a movable sleeve of a pilot stage valve in response to movement of the main stage valve's slide. The sleeve is thereby caused to move in a direction opposite to the direction of movement of the main stage valve's slide to cause a blocking of certain of the sleeve's ports. A spring is employed to help eliminate lost motion between the pivot member and the pilot stage valve's sleeve.

There are a number of problems associated with prior art electro-hydraulic servovalves. Most of the problems are linked to the valve's position-sensing and feedback systems.

Many prior art valves exhibit hysteresis arising from the indirect coupling of the main and pilot stages of the valve and also from frictional and/or dampening forces associated with the functioning of the feedback mechanism. For proper operation of the valve, this effect must be compensated for by either the operator or by apparatus associated with the valve.

The position-sensing and feedback portions of many prior art valves adversely affect the valve's durability and reliability. One cause of this is the large number of parts normally required for the sensing and feedback mechanisms. The complex interactions between the many elements and the criticality of each element are all possible failure points. Exacerbating this problem is that contaminants in the working fluid can cause corrosion of the mechanism and/or clog the narrow passages of fluid-based feedback systems.

The complex and sometimes extensive sensing and feedback mechanisms of prior art valves also increase the valve's cost and maintenance requirements. The often problematic accessibility of the position-sensing and feedback components typically exacerbates this problem.

Adjustability of prior art valves, when available, can also be difficult to achieve properly. In some cases, adjustability of the feedback mechanism requires significant disassembly of the valve that may include violating the valve's fluid boundary. If the valve is located in a sealed system, violating the fluid boundary to gain access to the feedback mechanism may necessitate re-testing of the entire fluid system.

Prior art servovalves that employ electronic position sensors can also be adversely affected by temperature. It is not uncommon for an electronic component's null point to shift with temperature changes. This results in inaccurate performance of the components.

Lastly, the design of servovalves of the type shown by Horlacher and Hayner et al is limited by the structure and functionality of the position sensing and feedback mechanisms. The mechanisms require that if the valve is to have a compact design, movement of the main stage valve's slide in one direction must result in the pilot stage valve's sleeve moving in an opposite direction. This limits the design and location of the pilot stage valve's porting.

SUMMARY OF THE INVENTION

The invention is a unique mechanical position-sensing and feedback system located between the main and pilot stages of an electro-hydraulic servovalve. The position-sensing and feedback system makes use of a rotatable member that interconnects the main and pilot stages of the valve.

The main stage of the servovalve is in the form of a spool-type valve that features a translatable slide (also known as a spool) within a fixed sleeve. In this application, the main stage valve's slide will hereinafter be referred to as the main stage slide and the main stage valve's sleeve will hereinafter be referred to as the main stage sleeve. It should be noted that a "sleeve" is herein broadly defined to be a cylindrical receiver for the slide and may be a separate member received within a complementary cavity in the valve body or merely a cylindrical chamber formed within said body. The sleeve includes ports that lead to and from a supply of pressurized fluid and to and from a hydraulically connected load.

The pilot stage of the servovalve is in the form of a spool-type valve that features a movable slide within a movable sleeve. In this application, the pilot stage valve's slide will hereinafter be referred to as the pilot stage slide and the pilot stage valve's sleeve will hereinafter be referred to as the pilot stage sleeve. The pilot stage sleeve is translatable within a complementary bore in the valve body. A plurality of ports are located in the sleeve and enable pressurized fluid to travel to or from a supply of pressurized fluid and to or from the servovalve's main stage. The position of the sleeve in conjunction with the position of the slide determines whether and in what manner fluid will flow to the servovalve's main stage.

Movement of the pilot stage slide occurs through the use of a spring-centered linear force motor. Application of an electrical current to the motor causes a translation of a center-located shaft that is an extension of the pilot stage slide. In this manner, a user in a remote location can cause a translation of the pilot stage slide.

To enable adjustment of the valve, one end of the actuator's center-located shaft is secured within a threaded extension of the actuator's armature. A user can remove an access cover and then manually rotate the shaft relative to the armature extension to cause a change in the shaft's position relative to said extension. This effectively changes the position of the connected pilot stage slide.

The position-sensing and feedback requirements of the servovalve are achieved using a single, rotatable feedback link that engages the main stage slide and the pilot stage sleeve. In the preferred embodiment, the link is located within a cavity in the valve block and is rotatably secured to said block by a plurality of bearing-type supports.

At one end of the feedback link is a first, outwardly-extending tang that is offset from the longitudinal axis of the link's main body. A second end of the link features a second outwardly-extending tang that is also offset from the longitudinal axis of the link's main body. The first tang is engaged to the pilot stage sleeve and the second tang is engaged to the main stage slide. In this manner, movement of the main stage slide causes a rotation of the link and a corresponding movement of the pilot stage sleeve. When both tangs are offset in a manner whereby they are both located on the same side of the link, the pilot stage sleeve will move in the same direction as the main stage slide. When the two tangs are offset in a manner whereby each is located on an opposite side of the link, the pilot stage sleeve will move in a direction opposite to the direction of movement of the main stage slide.

The uncomplicated and direct nature of the combination position-sensing and feedback and mechanism makes it highly reliable and durable. The small number of interconnected parts and low friction of the bearing supports helps the system to avoid the hysteresis problems of the prior art. Furthermore, corrosion and/or clogging of the feedback mechanism is minimized or avoided since the feedback mechanism is not dependent on a fluid link for its operation. The readily accessible and easy to operate adjustment mechanism also is an improvement over many of the prior art servovalves. Since the system makes use of a mechanical-type mechanism for position sensing, the invention avoids the temperature sensitivity of prior art systems that employed electronic position sensors.

It should also be noted that unlike the feedback systems taught in the Hayner and Horlacher valves, the system employed in the invention is uncomplicated and does not have the large space requirements necessitated by a pivoting feedback link. In addition, the elongated body of the invention's feedback link enables support at multiple locations along its length. This avoids the reduced reliability and higher loadings necessitated by the single bearing support of a pivoting member. Furthermore, the noted prior art valves require the pilot stage sleeve to move in a direction opposite to the direction of movement of the main stage slide. Significant changes in the structure of the valves is required if it is desired for the pilot stage sleeve to move in the same direction as that of the main stage slide. In the invention, the direction of movement of the pilot stage sleeve is purely dependent on the relative positions of the feedback link's tangs. Should it be desirable from a design or operational need to have the pilot stage sleeve move in one direction or another relative to the direction of movement of the main stage slide, one merely uses a feedback link that has its tangs in the proper position to achieve the desired operation.

DETAILED DESCRIPTION OF THE DRAWINGS

Figure 1:
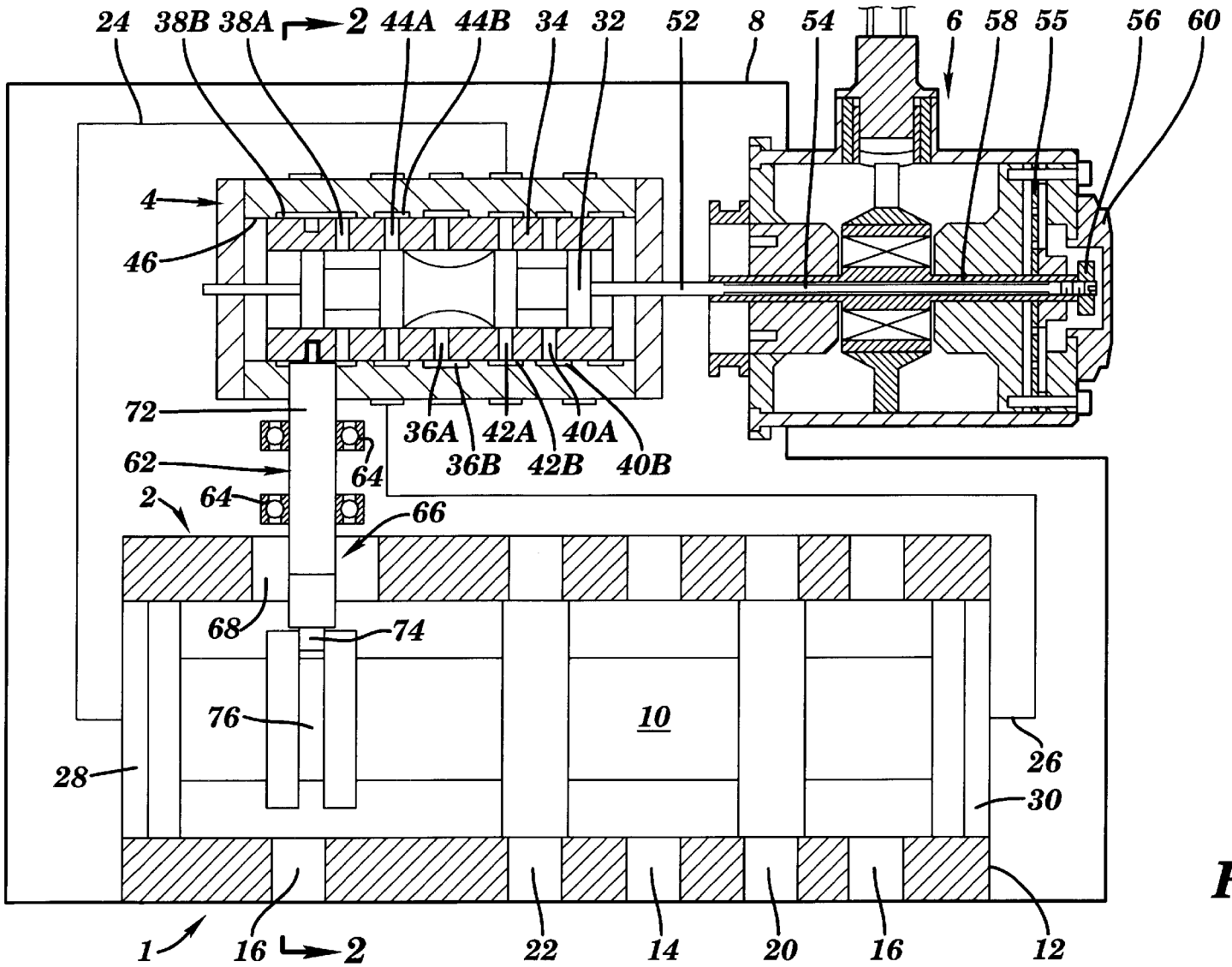
FIG. 1 is a side, partial cross-sectional view of a generalized electro-hydraulic servovalve that includes a position-sensing and feedback mechanism in accordance with the invention.

Referring now to the drawings in greater detail, wherein like reference characters refer to like parts throughout the several figures, there is shown by the numeral 1 an electro-hydraulic servovalve in accordance with the invention.

Servovalve 1 includes a main stage valve 2, a pilot stage valve 4 and a pilot actuator 6. As shown, the two valves are located within a common valve block or body 8. It should be noted that the separate components can alternatively be located spaced apart from each other in a manner whereby the two valves do not share a common body.

The main stage valve 2 of the servovalve is a spool-type valve and is composed of a main stage slide 10 that is contained within a cylindrical main stage sleeve 12. The sleeve features a port 14 that leads to a supply of pressurized fluid (not shown). The sleeve also includes ports 16 that provide a return to the sump (not shown) of the fluid supply. Ports 20 and 22 in the sleeve lead to a load (not shown). The load may be a hydraulic cylinder, hydraulic motor or any other component commonly controlled by a servovalve.

Located at one end of the valve 2 is a fluid channel 24. A similar channel 26 is located proximate an opposite end of the valve. Each of channels 24 and 26 lead into an associated chamber, 28 and 30 respectively, located adjacent to opposite ends of the main stage slide 10. The channels are fluid passages that lead to the pilot stage valve 4.

The pilot stage valve 4 comprises a pilot stage slide 32 that is translatable within a translatable pilot stage sleeve 34. The sleeve includes ports 36A, 38A, 40A, 42A and 44A and is located within a complementary bore 46 in the valve body. As can be seen in FIG. 1 with the valve shown in a neutral, null position, ports 36B, 38B, 40B, 42B and 44B in the bore are in alignment with the corresponding ports 36A–44A in the sleeve. In the preferred embodiment, port 36B is connected to a source of pressurized fluid, ports 38B and 40B are return lines to a sump for the pressurized fluid, port 42B opens to fluid channel 24 and port 44B opens to fluid channel 26.

The pilot stage slide 32 features an end-located extension member 52. As the slide translates within its sleeve, the extension member moves by the same amount in the same direction. As can be seen in FIG. 1, the distal end of member 52 is in the form of a center shaft 54 of the pilot actuator 6. Alternatively, member 52 and shaft 54 can be separate components linked together by a fixed connection that does not allow relative movement between the two components.

The pilot actuator 6 is preferably an electrically-powered force motor. When electrical power is administered to the force motor, the motor's center shaft 54 is caused to move to the left or the right and thereby cause an identical translation of the slide 32. In the preferred embodiment, the actuator includes a flexible, flat plate-type centering spring 55 that acts to maintain the shaft 54 in a centered position. When the shaft 54 is in its centered position, the pilot stage valve is in its null position. It should be noted that other conventional linear-action-type actuators can be used in lieu of the one shown.

In the preferred embodiment, the right-hand end of the shaft 54 is threaded and is threadedly-engaged to a nut 56. The nut is integral and movable with a translatable fixture 58 that extends from the motor's movable armature and surrounds shaft 54. When the actuator is energized, fixture 58 moves to the right or left. When access cover 60 is removed, a user can rotate the end of shaft 54 via the screwdriver slot shown. This causes said shaft to move relative to the fixture 58 and thereby adjusts the null position of the pilot stage slide 32.

When the actuator shifts slide 32 away from the centered, null position shown in FIG. 1, pressurized fluid is allowed to selectively enter one or the other of the channels 24 or 26 while the other of said channels provides a fluid return to the sump. The pressurized fluid travels through the channel and then to the associated chamber 28 or 30 located adjacent an end of slide 10. The difference in pressure between chambers 28 and 30 causes slide 10 to translate within its associated sleeve 12. As a result, pressurized fluid is allowed to travel from port 14 to one of the ports 20 or 22 to thereby cause pressurized fluid to travel to the load. It should be noted that translation of slide 10 also uncovers one of the return ports 16 to thereby allow fluid to return from the load to the sump.

As slide 10 moves within its sleeve, a combination position-sensing and feedback mechanism is operated. The mechanism functions to cause the pilot stage valve to be reset to a neutral or null position once the main stage slide attains the desired position.

Figure 2:
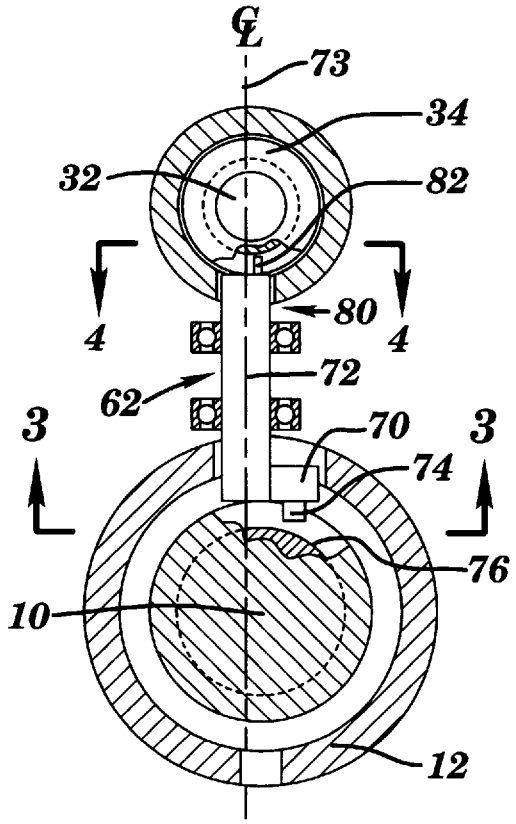
FIG. 2 is an end view, partially in cross-section, of the servovalve shown in FIG. 1 and taken at the plane labeled 2—2.
Figure 3:
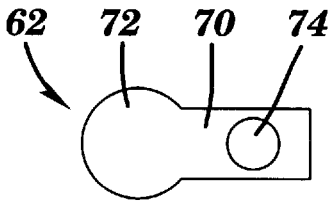
FIG. 3 is an end view of the feedback link shown in FIG. 2 and taken at the plane labeled 3—3.

The position-sensing and feedback mechanism includes a feedback link 62 that is rotatably secured within the valve block 8 by two rotatable supports 64 that inwardly contain roller or ball bearings. End portion 66 of the link extends through an aperture 68 in the main stage sleeve 12. As can be seen in FIGS. 2 and 3, end portion 66 includes a leg portion 70 that extends from the main body 72 of the link in a direction perpendicular to the longitudinal axis 73 of the link's body 72. A tang 74 extends outwardly from the leg portion and engages a slot 76 in the main stage slide 10. The engagement is such that the tang moves with and follows the slide but is free to rotate within the slot. The interaction between the tang and the slide effectively acts as a position sensing mechanism that monitors the position of the slide 10. It should be noted from FIG. 2 that the tang 74 is offset from axis 73 of the feedback link's body 72.

The feedback link also engages the pilot stage valve via an end portion 80 of the link (note FIG. 2). As can be seen in the figures, end portion 80 includes an outwardly-extending tang 82 that is received within a complementary cylindrical bore 83 in the sleeve and thereby rotatably engages the translatable pilot stage sleeve 34. It should be noted from FIG. 2 that tang 82 is also offset from axis 73 of the feedback link's body.

Figure 5:
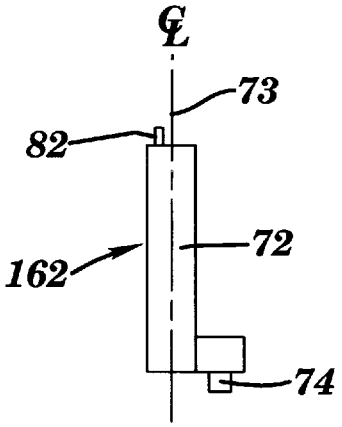
FIG. 5 is a side view of an alternate embodiment of a feedback link.
Figure 4:
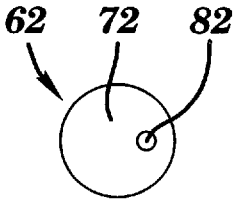
FIG. 4 is an end view of the feedback link shown in FIG. 2 and taken at the plane labeled 4—4.

As can be seen in FIGS. 2–4, the tangs 74 and 82 are both offset to the same side of the link (i.e.—they are both right of center of axis 73). The location of the tangs forces the pilot stage sleeve 34 to move in the same direction as the main stage slide 10. Per FIG. 1, as the slide 10 moves to the right, the sleeve 34 will also move to the right. FIG. 5 shows an alternate embodiment of a feedback link 162. This link is identical to link 62 except that link 162 features tangs 74 and 82 located on opposite sides of the link (i.e.—tang 74 is located to the right of axis 73 while tang 82 is located to the left of axis 73). When the tangs are located per this alternate embodiment, movement of slide 10 in one direction, for example toward the right, will cause the pilot stage sleeve 34 to move in an opposite direction, in this example, toward the left.

The operation of the position-sensing and feedback mechanism will now be fully described.

As slide 10 shifts or translates within its sleeve 12 through the action of the pilot stage valve, as described previously, the slide's engagement with the tang 74 causes the tang to move in the same direction as the slide 10. This inherently causes the leg 70 to move in an arc and the feedback link to rotate about the longitudinal axis 73 the link's body 72. As the link rotates, the tang 82 located on the opposite end of the link moves and causes the pilot stage sleeve 34 to move in the same direction as the slide 10 is moving. As the pilot stage sleeve shifts, a position where all ports 36A–44A are blocked is achieved and areas 28 or 30 of the main stage valve are at equal pressure. At this point, the servovalve is at a position proportional to the input signal that was sent to the actuator, and is stable. The valve will return to the position shown in FIG. 1 only after a null input command signal is sent to the actuator to cause the appropriate shifting of the slide 32.

It should be noted that while the engagement between the feedback link and the main stage slide and pilot stage sleeve employs tangs 74 and 82 (a tang is herein defined as a member that can catch on or be received within a surface or bore of an adjacent element), other equivalent engagement structures may be substituted. For example, the associated slide and sleeve may have projections that are received within complementary apertures in the feedback link.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. An electro-hydraulic servovalve comprising:

a main stage that includes a valve having a slide translatable within a complementary ported sleeve, wherein said valve controls delivery of pressurized fluid from a fluid supply to a load dependent on the location of the slide within the sleeve;

a pilot stage that includes a valve having a slide translatable within a translatable ported sleeve, and wherein said pilot stage is hydraulically connected to the main stage in a manner whereby movement of the pilot stage slide is capable of causing the main stage slide to translate within its associated sleeve;

an actuator that is operatively connected to and can affect the pilot stage valve; and a feedback mechanism that is operatively connected to the main stage valve and to the pilot stage valve and functions to cause a change in the pilot stage valve in response to movement of the main stage slide and wherein said feedback mechanism includes a rotatable feedback link having an elongated body portion that has a longitudinal axis, and wherein said feedback link has a first end portion engaged to the main stage slide and a second end portion engaged to the pilot stage sleeve and wherein when said main stage slide translates within its associated sleeve, the feedback link rotates about said longitudinal axis and causes a translation of the pilot stage sleeve.

2. The servovalve of claim 1 wherein the feedback link includes first and second engagement means that are each located at a position offset from the longitudinal axis of the link's body portion and wherein said first engagement means is located on the first end portion of the feedback link and engages the main stage slide and wherein said second engagement means is located on the second end portion of the feedback link and engages the pilot stage sleeve.

3. The servovalve of claim 2 wherein the first end portion of the feedback link includes an outwardly-extending leg portion that extends in a direction substantially perpendicular to the longitudinal axis of the link's body portion and wherein the first engagement means is located on said leg portion.

4. The servovalve of claim 2 wherein each of the first and second engagement means have a longitudinal axis that is oriented substantially parallel to the longitudinal axis of the feedback link's body portion.

5. The servovalve of claim 1 wherein a connector means connects the actuator to the pilot stage slide and wherein operation of the actuator causes force to be applied to the pilot stage slide via said connector means.

6. The servovalve of claim 1 wherein the actuator is electrically powered.

7. The servovalve of claim 1 wherein the feedback link is supported by a plurality of bearing means secured to a body of the servovalve.

8. The servovalve of claim 7 wherein at least one of said bearing means includes a plurality of rotatable bearing members.

9. The servovalve of claim 1 wherein one end of the feedback link includes a follower means, and wherein said follower means is engaged to the main stage slide.

10. The servovalve of claim 9 wherein the main stage slide includes a slot adapted to inwardly receive at least a portion of the follower means.

11. The servovalve of claim 1 wherein the main stage slide has a longitudinal axis and wherein the longitudinal axis of the feedback link's body portion is oriented substantially perpendicular to the main stage slide's longitudinal axis.

12. The servovalve of claim 1 wherein the main stage valve and the pilot stage valve are located proximate to each other and form a valve block means and wherein the feedback link is located within said valve block means.

13. The servovalve of claim 1 wherein the main stage slide has first and second linearly-separated ends and wherein an engagement means of the feedback link engages said main stage slide between said first and second linearly-separated ends.

14. The servovalve of claim 1 wherein the actuator includes an adjustment means capable of being accessed by a user and wherein adjustment of said adjustment means affects a null position of the pilot stage slide.

15. The servovalve of claim 1 wherein the feedback link has first and second sides and includes a first engagement means, wherein said first engagement means is located proximate the feedback link's first end portion and is offset from the longitudinal axis of the link's body portion toward one of said sides of said feedback link, said first engagement means functioning to engage the feedback link to the main stage slide, and wherein a second engagement means is located proximate the second end portion of the feedback link and is offset from the longitudinal axis of the link's body portion toward one of said sides of said feedback link, said second engagement means functioning to engage said feedback link to the pilot stage sleeve and wherein rotation of the feedback link in response to movement of the main stage slide causes a movement of the pilot stage sleeve and wherein the direction of movement of the pilot stage sleeve is dependent on the location of the first engagement means relative to said second engagement means.

16. The servovalve of claim 15 wherein said first and second engagement means are both offset toward the same side of the feedback link whereby movement of the main stage slide in a first direction causes the pilot stage sleeve to also move in said first direction.

17. The servovalve of claim 15 wherein said first and second engagement means are offset toward opposite sides of the feedback link whereby movement of the main stage slide in a first direction causes the pilot stage sleeve to move in a direction opposite to said first direction.

18. An improved servovalve of the type having a main stage valve in the form of a spool valve, a pilot stage valve in the form of a spool valve, and an actuator that acts on the pilot stage valve, wherein the improvement comprises:

a feedback mechanism operatively connected to the main stage valve and to the pilot stage valve and functioning to cause a change in the pilot stage valve in response to movement of a slide of the main stage valve and wherein said feedback mechanism includes a rotatable feedback link that has an elongated body having a longitudinal axis, wherein said feedback link has a first end portion engaged to the slide of the main stage valve and a second end portion engaged to a movable sleeve of the pilot stage valve, and wherein when the slide of the main stage valve translates within an associated sleeve, the feedback link rotates about said longitudinal axis and causes a translation of the sleeve of the pilot stage valve, and wherein translation of the sleeve of the pilot stage valve affects fluid flow to the main stage valve.

19. The servovalve of claim 18 wherein the feedback link has first and second sides and includes a first engagement means, wherein said first engagement means is located proximate the feedback link's first end portion and is offset from the longitudinal axis of the feedback link's body toward one of said sides of said feedback link, said first engagement means functioning to engage the feedback link to the main stage valve's slide, and wherein a second engagement means is located proximate the second end portion of the feedback link and is offset from the longitudinal axis of the feedback link's body toward one of said sides of said feedback link, said second engagement means functioning to engage said feedback link to the pilot stage valve's sleeve and wherein rotation of the feedback link in response to movement of the main stage valve's slide causes a movement of the pilot stage valve's sleeve and wherein the direction of movement of the pilot stage valve's sleeve is dependent on the location of the first engagement means relative to said second engagement means.

* * * * *